United States Patent [19]

Koepke et al.

[11] Patent Number: 4,479,987

[45] Date of Patent: Oct. 30, 1984

[54] PROCESS AND AN APPARATUS FOR STABILIZING FREE-FALLING LIQUID CURTAINS

[75] Inventors: Günther Koepke, Odenthal; Hans Frenken, Odenthal-Osenau; Heinrich Bussmann; Kurt Browatzki, both of Leverkusen, all of Fed. Rep. of Germany

[73] Assignee: Agfa-Gevaert Aktiengesellschaft, Leverkusen, Fed. Rep. of Germany

[21] Appl. No.: 563,817

[22] Filed: Dec. 21, 1983

[30] Foreign Application Priority Data

Jan. 4, 1983 [DE] Fed. Rep. of Germany ..... 3300150

[51] Int. Cl.[3] ..... B05D 1/34; B05D 1/30

[52] U.S. Cl. ..... 427/402; 427/420; 118/300; 118/DIG. 4; 118/325

[58] Field of Search ..... 118/300, DIG. 4, 325; 427/420, 402

[56] References Cited

U.S. PATENT DOCUMENTS 4,019,906 4/1977 Ridley ..... 118/DIG. 4
4,233,346 11/1980 Kerkhofs ..... 427/420

FOREIGN PATENT DOCUMENTS 2021001 11/1979 United Kingdom ..... 118/DIG. 4

*Primary Examiner*—Shrive P. Beck
*Attorney, Agent, or Firm*—Connolly and Hutz

[57] ABSTRACT

The stabilization of free-falling liquid curtains (4) in the coating of objects or webs (5) using curtain coaters is considerably improved by the use of curtain holders (9) from which an additional auxiliary liquid (11) issues towards and combines with the curtain (4), for laterally guiding the free-falling curtain (4) formed at the coating edge (3) of the coater. Triangular liquid bridges (14) are thus formed between the curtain (4) and the curtain holders (9) from the coating edge (3) to the point where the curtain (4) impinges on the layer support (5). The curtain holders (9) consist of tubular hollow bodies with a delivery spout (10) and a distributing passage (12) for the liquid (11) and an exit slot (13) or of a porous tubular material without any exit slot (FIG. 3).

12 Claims, 7 Drawing Figures

PROCESS AND AN APPARATUS FOR STABILIZING FREE-FALLING LIQUID CURTAINS

This invention relates to a process and an apparatus for stabilizing free-falling liquid curtains which comprise one or more layers in the curtain coating of webs or objects advancing continuously past a coating station.

Curtain coating processes are being used increasingly as precision coating processes in the furniture industry for coating boards, for coating other objects and, in the photographic industry, for simultaneously applying several photographic layers to moving webs of material. Curtain coating processes and suitable coating machines are known, for example, from U.S. Pat. Nos. 3,508,947; 3,632,374 and 3,867,901.

Of the many known curtain coating machines, two types above all are particularly important, namely the so-called slot coaters and the so-called slide coaters. In slot coaters, the coating liquid emerges at the lower end of an outflow gap arranged transversely over the support to be coated, immediately forming a free-falling curtain. By contrast, in slide coaters, the coating liquid is forced through a metering gap opening onto a downwardly sloping surface, flows down that surface in the form of a thin film under the effect of gravity and forms the free-falling curtain at the lower end of the sloping surface known as the coating edge. In both cases, the liquid curtain may comprise one or more layers.

The liquid curtain is applied to an object to be coated which advances continuously beneath the curtain.

In this process, the quality of coating is largely determined by the properties of the liquid curtain so that, in the case of slide coaters, it is important to ensure that, first of all, a stable, laminar flow liquid film is formed and that an equally stable, laminar flow liquid curtain is formed from that film. In the case of slot coaters, a stable liquid curtain must be immediately formed. Any deviations from the laminar flow result in coating errors. Coating errors such as these occur as a result of disturbances in particular along the edges because the free-falling liquid curtain strives to contract under the effect of its surface tension.

In order to avoid or prevent contraction of the curtain under the effect of surface tension, it is known that the curtain may be guided at its edges by curtain holders. In general, the curtain holders are made of a solid material (metal or plastics material) a few millimeters thick and are fastened to the two sides of the coating edge. The curtain holders are inclined inwards at an angle of 5° to 10° in the plane of the curtain to prevent the curtain from being torn away from the curtain holders. It is known from British Pat. No. 2,021,001 A that the usual, rigid curtain holders may be replaced by a circulating belt to reduce the friction of the liquid curtain on the curtain holders.

The curtain holders may be arranged in such a way that the material to be coated is coated almost up to the edge or right up to the edge or even in such a way that the width of the coating liquid extends beyond the web on both sides.

If a web is coated almost up to the edge, the coating terminates on both sides in a bead which has to be cut off with the uncoated edges.

Curtain holders which allow marginless coating terminate a few millimeters above the layer support material inside the edges of the web and are generally provided at their lower ends with smoothing elements (small plates or tufts of hair) which slide on the web and thus guide the free-falling curtain to the surface of the web. Curtain holders such as these are known from U.S. Pat. No. 3,867,901. Although such curtain holders enable beadless coating edges to be obtained, they are nevertheless attended by serious disadvantages. The smoothing process which takes place along the actual edges of the layer support and below the curtain holder produces irregularities which seriously limit the useful width of the coated material. The useful width of the free-falling liquid curtain is reduced by the curtain holders inclined inwards at 5° to 10°, so that the coating machines for producing the curtain have to be wider than the material to be coated. In addition, the smoothing elements can become encrusted over a period of time so that they are no longer able to perform their function of distributing excess coating material. This results in thickening of the peripheral bead which is not dried in the following dryer, resulting in blocking of the webs after they have been rolled up.

In the third type of lateral curtain guiding system, the curtain holders are arranged so far from the edges of the material to be coated that the curtain is wider than the material to be coated. In this case, the material is completely coated over its entire width, any peripheral irregularities being situated in the vicinity of the curtain holders and, hence, outside the useful width of the web.

The coating liquid which drops down past the edges of the web is collected in collecting tanks for re-use. Using this process, coating may be carried out at high speed in one or more layers. However, this process is attended by serious disadvantages. Since the curtain is generally 1 to 6 cm wider on each side than the web to be coated, the entire coating machine has to be made correspondingly wider and the metering units corresponding larger. Since the photographic industry is concerned primarily with multilayer coating, the mixed layers falling past the edges can no longer be used and, hence, represent losses. For a web width of 100 cm, an average of up to 10% of the valuable coating material is lost, which is unacceptable.

In order to avoid these losses, attempts have been made to divide up a multilayer curtain over its width, the high-quality, expensive layers being used in accordance with the useful width of the material to be coated and the less expensive layers being used for guiding the curtain along the curtain holders.

According to European patent application No. 0 003 860, at least one relatively wide, bottom layer is initially produced, the narrower, expensive layers flowing onto that bottom layer in the coating machine. The layers thus combined are then applied as a common free-falling curtain to a web. In this way, the high-quality layers are said to be applied without losses to the web between the edges thereof without coming into contact with the curtain holders. The connection with the curtain holders is established by the wider, less expensive layer. The auxiliary coating liquid which drops past the edges of the web is collected and re-used.

A similar solution to the problem is known from German Offenlegungsschrift No. 24 48 440. In this case, the coating liquids emerge alongside one another onto the downwardly sloping surface of a coating machine, the more valuable layer being situated in the middle and being joined at both edges to the auxiliary layers, so that during the free fall the auxiliary layers slide along the curtain holders and prevent the middle layer from overcontracting.

The last two processes are not suitable for the more conventional coatings comprising a plurality of individual layers differing in viscosity and solids content, because in the practical application of these processes the curtains are frequently torn at the "seams" between their inner and outer layers or between their outer layers and the curtain holders, resulting in interruptions in the coating process and hence in considerable losses of material. Even coordination of the surface tensions with the thickness or viscosities of the layers does not provide a stable solution for the free-falling curtain.

The last two processes are attended by the further disadvantage that, on detachment from the coating edge, the two layers situated at the border of the curtain contain only a certain quantity of liquid which accelerates during the free fall and becomes as diluted as the free-falling curtain between those layers. In these processes, therefore, it is also necessary to use curtain holders which are inclined inwards towards the layer support and which prevent the curtain or the side layers from tearing through contraction of the curtain.

All known curtain coating machines incorporating curtain holders are attended by the serious disadvantage that the curtain holders themselves do not make any significant contribution towards improved wetting in the tearing-prone peripheral zone of the curtain at the curtain holders. Even the positive inclination of the curtain holders (i.e. inwards towards the curtain), which is attended by other disadvantages, fails to provide adequate stability of the curtain along its edges in all practical coating functions.

Accordingly, the object of the present invention is to provide a process and an apparatus of the type mentioned at the beginning by which it is readily possible to guide a free-falling liquid curtain at its edges in such a way that the losses of high-quality coating materials are avoided, thick beads are prevented from forming at the edges, the stability of coating is increased by effective working at the edges and marginless coating can be carried out free from any problems.

Starting with a process and an apparatus of the kind mentioned at the beginning, the invention achieves this object by the use of curtain holders from which an additional liquid issues towards the curtain, combining with the curtain and forming from the coating edge to the point where the curtain impinges on the layer support, triangular, stabilizing liquid bridges between the curtain and the curtain holders, for laterally guiding the free-falling curtain formed at the coating edge of the coating machine.

In one advantageous embodiment of the process, the quantity of liquid introduced into the curtain holders for laterally guiding the curtain is metered in such a way that the liquid bridges begin directly at the coating edge and become triangularly wider in the direction of fall of the curtain, enabling the free-falling curtain to undergo a stabilizing contraction.

The process provides very good results when low-viscosity liquids having viscosities of from 1 mPas to 20 mPas and preferably from 1 mPas to 10 mPas are used for forming the liquid bridges between the curtain and the lateral curtain holders.

In one particularly advantageous embodiment of the process, the width of the curtain and the quantity of liquid issuing from the curtain holders are gauged in such a way that the layer support is coated with coating liquid right up to its edges and in such a way that the liquid issuing laterally from the curtain holders takes over the wetting of the edges of the layer support and, unless it impinges on the web, the liquid is collected and re-used.

It has surprisingly been found that a self-adjusting liquid bridge which, unexpectedly, stabilizes the curtain at the curtain holders is formed by the additional introduction of liquid through a 0.2 to 0.8 mm, and preferably 0.3 to 0.4 mm, wide gap formed longitudinally of the curtain holder and directed inwards towards the curtain. Closer investigation has shown that this effect is attributable to the following fluid-flow and physical factors:

At its centre or up to a few centimeters inwards from the curtain holders, the curtain is accelerated in accordance with the law of gravity and, after only 5 cm for example, is falling at a rate of approximately 100 cm/s. The coating liquid in the vicinity of the curtain holders falls at a considerably lower speed because it is decelerated on sliding along the curtain holders. Whereas, at its centre, the curtain falls at a speed corresponding to the particular height of fall h, the speed in the vicinity of the curtain holders diminishes and reaches a minimum directly at the curtain holder, namely the vertical flow rate. The various speeds within the curtain also produce varying thicknesses. Accordingly, the curtain is thinner at its centre, where it falls freely, than at its edges in the vicinity of the curtain holders. The contraction forces generated by the surface tension of the curtain act on the thicker layer of the curtain in the peripheral zone, so that the curtain is weakened approximately 1 to 2 centimeters from the curtain holder and, hence, would preferentially tear in that zone. The risk of tearing may be reduced by inclining the curtain holders. As mentioned above, however, significant positive inclination of the curtain holders inwards towards the curtain is undesirable because it involves other serious disadvantages. The greater tendency towards tearing of the curtain with vertically arranged, outwardly or only slightly inwardly, inclined curtain holders is eliminated by the process according to the invention.

The tendency of the curtain to contract under the effect of its surface tension is accepted to a certain, predetermined extent by the separate lateral introduction of auxiliary liquid, resulting in greater stability of the curtain at its edges. The liquid is positively delivered to the curtain at its edge in a quantity steadily increasing from the coating edge in the direction of fall of the curtain up to the point at which the curtain impinges on the article to be coated, so that the liquid bridge between the edges of the curtain and the curtain holders becomes increasingly wider and hence satisfies the requirement of a certain stabilizing contraction of the curtain. Optimal stabilization of the curtain is possible by adapting the viscosity, surface tension and quantity of the laterally delivered liquid. The liquid bridge may be regarded more simply as an elastic spring between the curtain and the curtain holders which independently performs an equalizing function in a surprisingly simple manner.

It was also surprising to find that, in the process according to the invention, there is a considerable improvement in the wetting of the web along its edges with a considerable reduction in the thickness of the peripheral bead. In particular, the curtain can be completely prevented from tearing by using low-viscosity liquids for forming the liquid bridge.

According to the invention, the curtain coater incoporating a stabilizing system for the free falling curtain for the single-layer or multiple-layer coating of layer supports, such as webs or objects, advancing continuously past a coating station, is distinguished by the fact that, arranged between the coating edge of the coater and the web for laterally guiding the curtain on both sides, are internally hollow curtain holders which are provided with a separate liquid supply over their entire length and with a distributing passage and dispenser for the auxiliary liquid directed towards the curtain for forming liquid bridges between the curtain and the curtain holders.

One particularly advantageous embodiment of the apparatus according to the invention is distinguished by the fact that the curtain holders are hollow bodies closed on top and underneath which are connected to a liquid supply system of which the interior acts a distributing passage for the auxiliary liquid and by the fact that, to form the liquid bridges towards the curtain, the tubular hollow bodies are provided with a slot for dispensing the auxiliary liquid.

In another equally advantageous embodiment of the invention, hollow bodies closed on top and underneath of a porous, liquid-permeable material are used as curtain holders for the apparatus, being provided with a liquid supply system and being covered over their entire surface with a layer of liquid for forming the liquid bridges.

Under the effect of the surface tension of the curtain and its contraction forces, the liquid issuing around the porous curtain holders is drawn towards the curtain so that the forces which would otherwise result in tearing of the curtain are compensated by the drawing off of the additional liquid.

Another embodiment is distinguished by the fact that the curtain holders are hollow bodies closed on top and underneath with a liquid supply system which are provided towards the curtain with a dispensing slot, the slot being lined with porous, liquid-permeable material.

The apparatus is distinguished by the considerable improvement in the coating conditions, by the fact that it can be manufactured simply and inexpensively and by the possibility of fitting the curtain holders to existing coaters, in which case the curtain holders are arranged immediately adjacent the coating edge of a coating machine so that the liquid bridges begin directly at the coating edge, and are arranged in such a way that they can be pivoted through an angle $-\alpha$ towards the curtain and through an angle $+\alpha$ away from the curtain in the plane of the vertically free-falling curtain, the angle $\alpha$ being variable from $-10°$ to $+10°$ and preferably from $-5°$ to $0°$.

In addition, the apparatus according to the invention may be adapted within wide limits to deal with all coating problems, the quantity of liquid introduced into the curtain holders being variable for the purpose of selecting the width of the liquid bridges at the point where the curtain impinges on the layer support, so that relatively small or relatively large triangular liquid bridges are formed on both sides of the curtain, depending upon the quantity of liquid introduced.

The surprising effects mentioned above could not be foreseen by the expert and constitute a significant technical advance. Their particular value in coating with the apparatus and the process using liquid bridges is summarized in the following:

Smaller losses of coating liquids through vertically or very slightly negatively arranged curtain holders.

The coaters may be made narrower and the metering units smaller for marginless and non-marginless curtain coating.

The greater stability of the curtain eliminates or considerably reduces the losses caused by tearing of the curtain.

Peripheral interruptions in the coating are avoided through the better wetting of the edges.

Wave-like faults attributable to lack of uniformity or to the build up of crusts or deposits on the curtain holders are avoided by suitable liquids having a "flushing effect", so that coating of consistently high quality is guaranteed.

The peripheral beads are reduced or avoided, thereby saving drying capacity.

The advantages mentioned above result in a considerable reduction in production costs, in better utilization of machinery and in an improvement in the quality of the coating on the materials to be coated.

Embodiments of the apparatus according to the invention are described by way of example in the following with reference to the accompanying drawings, wherein.

Figure 1:
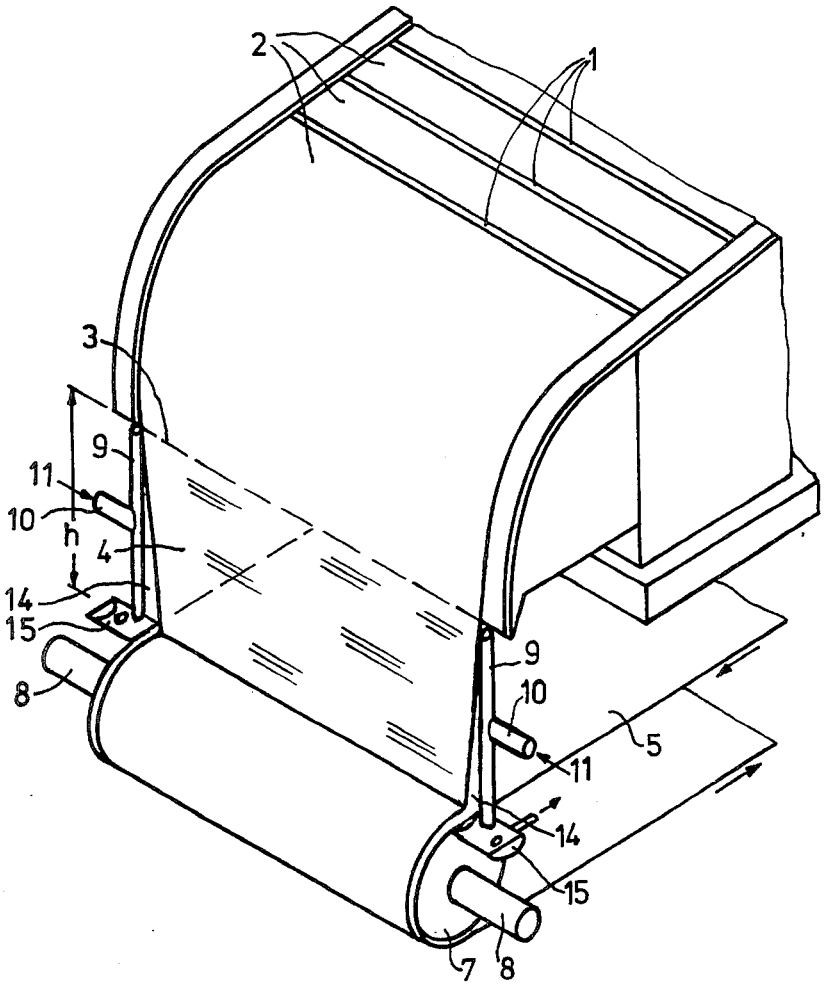
FIG. 1 is a simplified perspective view of a curtain coater incorporating a stabilizing system.

A curtain coater of the slide or nozzle type is shown in FIG. 1. The coating liquids are delivered laterally to the coater (not shown), ascend to exit slots 1 (see FIG. 2) and are deposited in the form of a layer on the inclined surfaces 2. Under the effect of gravity, the individual layers flow down the surfaces 2, pile up on top of one another and flow to the nozzle-like coating edge 3 where a free-falling curtain 4 is formed. The free-falling curtain 4 thus formed impinges over a height h on the continuously advancing (arrows) web 5 on which it accumulates in the form of a collection of layers.

At the point where the curtain 4 impinges, the web 5 is guided onto and around a coating roller 7. The width of the coating roller 7 is narrower than the width of the web 5 guided around it, so that the edges of the web are free. The coating roller 7 is mounted on and driven by a relatively wide shaft 8.

Figure 3:
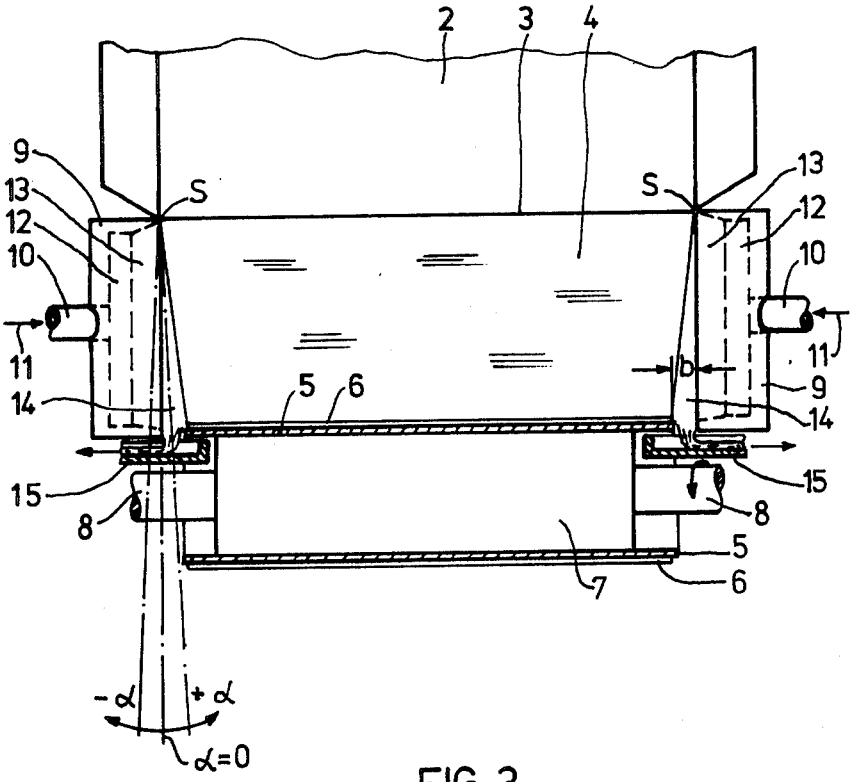
FIG. 3 is an elevation of the curtain coater shown in FIG. 1 from the curtain side.

The free-falling liquid curtain 4 is laterally guided by two curtain holders 9 which, contrary to known coating machines, are vertically arranged, i.e. at an angle $\alpha$ of 0° (FIG. 3). However, to prevent the curtain 4 from being torn off the curtain holders 9, an auxiliary liquid is delivered to the curtain holders 9 through a supply pipe 10. The liquid 11 delivered to the curtain holders 9 is distributed in a distributing passage 12 (FIG. 3) over the entire height of the curtain holder from the coating edge 3 to the point at which the liquid curtain 4 impinges on the web 5 and issues from a slot 13 (FIG. 3)

towards the free-falling liquid curtain 4 with which it forms a triangular liquid bridge 14 which stretches the curtain 4 like an elastic spring between the curtain holders 9. At the coating edge 3, the liquid bridge 14 has the width O because the supply of liquid 11 begins at that point. The liquid bridge 14 becomes steadily wider towards the curtain because the quantity of liquid issuing from the slot 13 adds up. At the lower end of the curtain holder 9, the liquid bridge 14 reaches a width b (FIG. 3). The self-adjusting triangular form of the liquid bridge 14 surprisingly corresponds exactly to the stability requirements of the curtain 4 and, in addition, provides for inexpensive, high-quality coating of the web 5.

Using the coater illustrated in FIG. 1, the web 5 may be coated with the coating liquid and the curtain 4 either beyond its entire width or exactly up to its edges or, finally, up to a few millimeters short of its edges. In FIG. 1, the coating stops short of the edges of the web so that the peripheral zones of the web 5 are very effectively wetted, the peripheral beads of the coating material are considerably reduced and high-quality coating liquids are saved. In FIGS. 1 and 3, a narrow peripheral strip of the web is wetted and coated with the auxiliary liquid 11. The remaining auxiliary liquid 11 which drops through between the edges of the web and the curtain holders 9 is thus free from high-quality coating liquids and is collected in collecting trays 15 and re-used (cf. arrow).

Figure 2:
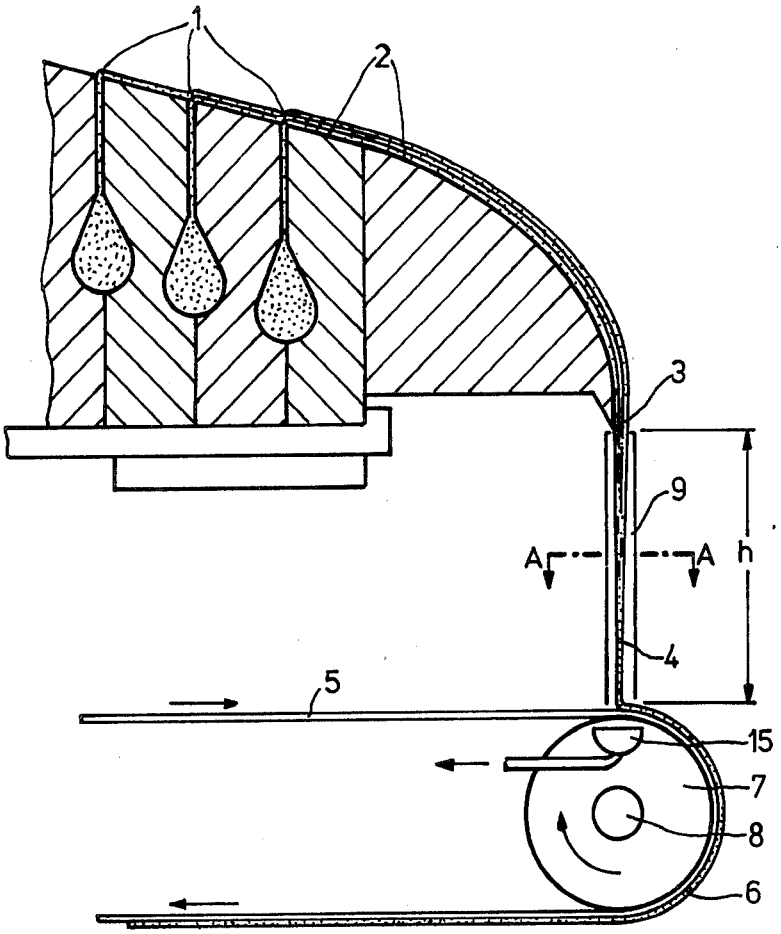
FIG. 2 is a section through the simplified curtain coater shown in FIG. 1.

The above-mentioned function of a nozzle curtain coater is illustrated in FIG. 2. The layers which are deteched at the coating edge 3 drop as a free-falling liquid curtain 4 over the height h onto the underlying, continuously advancing layer support 5, for example a photographic film or paper web, and accumulate as a collection of layers 6. During its free fall, the constituent liquid of the curtain 4 is accelerated so that the curtain 4 becomes increasingly thinner towards the web 5. Contraction forces are generated in the curtain, tending to reduce its width. Although this contraction may be counteracted to some extent by curtain holders 9, the curtain 4 is in danger of detaching itself from the curtain holders, i.e. of tearing, for the slightest reason. This danger does not exist in the process according to the invention and the corresponding apparatus with curtain holders which are supplied with an additional auxiliary liquid and apply this to the edges of the curtain 4, as can be seen in particular from FIG. 3.

FIG. 3 is a plan view of the free-falling curtain 4 and the liquid bridges 14 on both sides of the curtain 4. The liquid bridges 14 are formed by the curtain holders 9 into which an auxiliary liquid 11 is laterally introduced through spouts 10. The auxiliary liquid 11 is distributed over the entire height in distributing tubes 12 in the curtain holders 9 and issues through an narrow slot or gap 13 in the plane of and towards the curtain 4 and combines with the consistuent liquid of the curtain 4 at the actual coating edge 3. The issuing auxiliary liquid 11 adapts itself to the contraction of the curtain 4 so that a triangular liquid surface is formed as a liquid bridge 14. The excess auxiliary liquid 11 which falls past between the curtain holders 9 and the edges of the web 5 is collected in collecting trays 15 and re-used.

The curtain holders 9 are shown in the vertical position ($\alpha=0°$). They are advantageously arranged to tilt about a pivot on the coating edge 3 in the plane of the curtain 4 and may thus be moved through an angle ($+\alpha$, $-\alpha$). Surprisingly, it is advantageously possible using this process and the corresponding apparatus to adjust not only positive angles $\alpha$ of, for example, from $+5°$ to $+10°$, but also—and preferably—angles $\alpha$ of from $\pm 0°$ to $-10°$ without the liquid curtain tearing.

By virtue of this additional adjustability, coupled with the possibility of selecting the quantity of type of auxiliary liquid used, it is possible to solve virtually any coating problem encountered in curtain coating with a plurality of individual layers applied at the same time.

Aqueous solutions containing added wetting agents may be used as the auxiliary liquids in the curtain holders. Gelatin solutions of appropriate concentration with or without added wetting agents are also suitable. Other polymers, such as for example cellulose esters (Kelco), polyacrylamide, etc., are also suitable for use as viscosity regulators. In cases where coating is carried out with solvent-containing layers, for example with magnetic lacquers, the curtain holders are supplied with appropriate combinations of solvents.

FIGS. 4 to 7 are cross-sections on the line A—A in FIG. 2 through various embodiments of the curtain holders 9.

Figure 4:
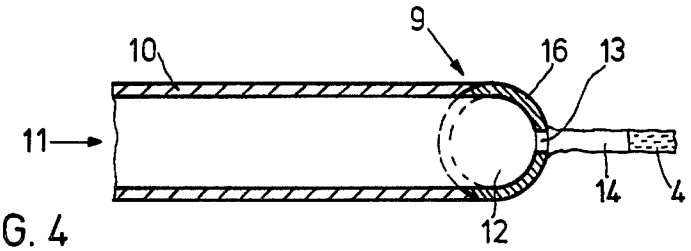
FIG. 4 is a section through a hollow circular curtain holder along the line A—A in FIG. 2.

FIG. 4 shows a particularly simple curtain holder 9. In this case, a tube 16 closed on top and underneath was provided with a narrow slot 13, the internal bore being used as a distributing passage 12. The distributing passage 12 is provided with a delivery spout 10 through which the auxiliary liquid 11 is delivered. The slot 13 is arranged towards the curtain 4 and has a width of from 0.2 to 0.8 mm and preferably from 0.3 to 0.4 mm. The auxiliary liquid 11 issuing from the slot 13 forms a liquid bridge 14 to the curtain 4.

Figure 5:
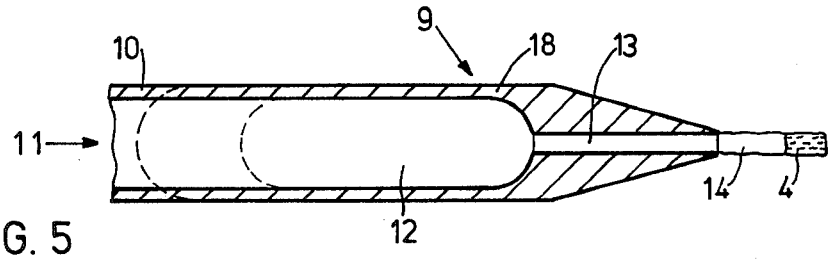
FIG. 5 is a section through an elongate curtain holder along the line A—A in FIG. 2.

FIG. 5 is a section through a special embodiment of a curtain holder 9 which has a flat, elongate cross-section and comprises a large distributing passage 12 and a long slot 13 for the controlled discharge of the auxiliary liquid 11 to form a stable liquid bridge 14 to the curtain 4. The auxiliary liquid 11 is delivered to the distributing passage 12 through a spout 10.

Figure 6:
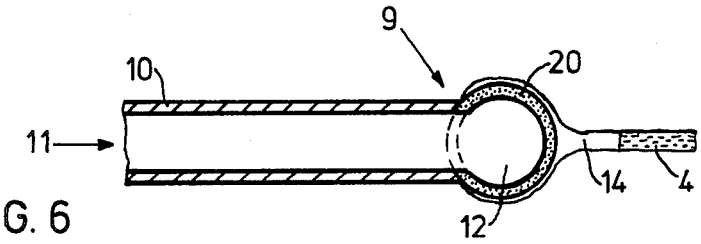
FIG. 6 is a section through a curtain holder of porous material along the line A—A in FIG. 2.

In FIG. 6, a tube closed on top and underneath of a porous liquid-permeable material 20 is used as the curtain holder 9. The auxiliary liquid 11 is delivered through a spout 10 to the bore 12 serving as the distributing passage. In this case, there is no need for a gap because the liquid 11 is driven through the pores under the pressure of the metering unit and forms around the tube a continuous liquid film which becomes correspondingly thicker in the direction of fall of the curtain 4 and which is withdrawn from the curtain 4 as a liquid bridge 14. In addition, the film formed around the tube 20 prevents encrustation and hardening in the case of particularly volatile substances and flushes away deposits, such as dust or fluff from the atmosphere.

Figure 7:
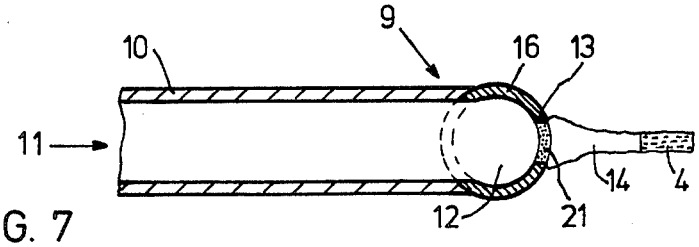
FIG. 7 is a section on the line A—A in FIG. 2 through a tubular curtain holder having a slot filled with porous material.

FIG. 7 shows a curtain holder 9 of the type illustrated in FIG. 4 of which the gap 13 is made considerably wider to avoid encrustation and in which a porous liquid-permeable material 21 is incorporated.

Other embodiments for the curtain holders 9 are possible, for example with triangular or other cross-sections, although they have not been shown because they are similar in principle to those illustrated.

The process and apparatus have been described with reference to a nozzle curtain coater, although they are by no means limited to this variant of the curtain coating technique. The described curtain holders may be used in same way as in any curtain coating machine, for example even in a curtain coater in which the coating liquid is delivered to a coating edge from both sides (cf European Pat. No. 0 017 126), in slot coaters, extruder coaters or even in overflow coaters where the coating liquid flows from a container over a weir and, from the weir, is applied as a free-falling curtain to a material to be coated.

In addition, the described curtain holders are also suitable for non-photographic coatings, for example for coatings using magnetic lacquers, paints, glues, polymer solutions or similar coating liquids.

EXAMPLES

The following Examples illustrate the advantages of the process according to the invention using the described apparatus for the production of photographic materials. The following symbols and dimensions are used in the Examples:

$\eta$—(mPa.s) viscosity $\sigma$—(mN/m) surface tension s—($\mu$m) wet coating applied to the layer support q—(1/m min.)metered quantity in liters per meter of web width for the coating material or liters per meter of curtain height for each curtain holder and per minute CM—coating material for the curtain AL—auxiliary liquid in the curtain holder

EXAMPLE 1

A coater of the type illustrated in FIG. 1 was provided with curtain holders of the type shown in FIG. 5 and used for one-layer coating. The curtain height h was 50 mm and the speed of travel of the web v=100 m/minute. A PE-coated, 230 $\mu$m thick paper web was used as the layer support. The curtain holders were vertically arranged ($\alpha$=0°). The coating width amounted to 11 cm.

| | Curtain holders | Curtain |
|---|---|---|
| CM | — | red colored gelatin solution |
| AL | water and wetting agent | — |
| $\eta$ | 1 | 30 |
| $\sigma$ | 34 | 29 |
| s | — | 100 |
| q | 1 | 10 |

The coating quality was good with a very thin bead at the edge of the web. The curtain showed high stability. There were no losses of valuable coating material.

EXAMPLE 2

A coater of the type shown in FIG. 1 was provided with curtain holders of the type shown in FIG. 5 and used for three-layer coating. The curtain height h was 50 mm and the speed of travel of the web v=400 m/min. A triacetate film 128 $\mu$m thick was coated. The curtain holders were vertically arranged ($\alpha$=0°). The coating width amounted to 11 cm.

| | Curtain holders | Curtain | | |
|---|---|---|---|---|
| | | Layer 1 | Layer 2 | Layer 3 |
| CM | — | aqueous gelating solution | aqueous gelatin solution | aqueous gelatin solution |
| AL | colorless gelatin solution | — | — | — |
| $\eta$ | 3 | 5 | 50 | 10 |
| $\sigma$ | 33 | 28 | 28 | 28 |
| s | — | 10 | 50 | 20 |

-continued

| | Curtain holders | Curtain | | |
|---|---|---|---|---|
| | | Layer 1 | Layer 2 | Layer 3 |
| CM | — | aqueous gelating solution | aqueous gelatin solution | aqueous gelatin solution |
| AL | colorless gelatin solution | — | — | — |
| q | 1.5 | 4 | 20 | 8 |

The coating quality was good with a very thin bead at the edge of the web. The curtain showed very high stability.

EXAMPLE 3

A coater of the type shown in FIG. 1 was provided with curtain holders of the type shown in FIG. 5 and used for three-layer coating. The curtain height h was 50 mm and the speed of travel of the web v=400 m/minute. A PE-coated paper 230 $\mu$m thick was used as the layer support. The curtain holders were arranged outwards at an angle $\alpha$ of −2.5° to the vertical.

| | Curtain holders | Curtain | | |
|---|---|---|---|---|
| | | Layer 1 | Layer 2 | Layer 3 |
| CM | — | Aqueous gelatin solution | aqueous gelatin solution | aqueous gelatin solution |
| AL | water + thickener, dye and wetting agent | — | — | — |
| $\eta$ | 10 | 4 | 100 | 100 |
| $\sigma$ | 39 | 27.4 | 28.3 | 28.3 |
| S | — | 10 | 50 | 50 |
| q | 0.9 | 4 | 20 | 20 |

The coating quality and curtain stability were very good with a very thin bead at the edge of the web. The layer width produced by the curtain itself on the web corresponded exactly to the width of the layers dropping down from the coating edge.

EXAMPLE 4

A coater of the type shown in FIG. 1 was provided with curtain holders of the type shown in FIG. 5 and used for two-layer coating. The curtain height h was 50 mm and the rate of travel of the web v=350 m/minute. A PE-coated paper 230 $\mu$m thick was coated. The curtain holders were arranged outwards at an angle $\alpha$−2.5° to the vertical. The coating width amounted to 13.9 cm.

| | Curtain holders | Curtain | |
|---|---|---|---|
| | | Layer 1 | Layer 2 |
| CM | — | Water and thickener | water and thickener |
| AL | water + thickener, dye and wetting agent | — | — |
| $\eta$ | 10 | 100 | 100 |
| $\sigma$ | 39 | 29 | 29 |
| s | — | 50 | 50 |
| q | 1 | 17.5 | 17.5 |

The coating quality and curtain stability were very good. The layer thickness on the web corresponded to the width of the layers on the inclined surface of the coater.

EXAMPLE 5

A coater of the type shown in FIG. 1 was provided with curtain holders of the type shown in FIG. 5 and used for three-layer coating. The curtain height h was 45 mm and the rate of travel v of the web 400 m/minute. A PE-coated paper 230 μm thick was coated. The curtain holders were arranged at an α of −2.5° to the vertical.

| | Curtain holders | Curtain | | |
|---|---|---|---|---|
| | | Layer 1 water and thickener | Layer 2 | Layer 3 |
| CM | — | | glycerol | glycerol |
| AL | water + thickener, dye and wetting agent | — | — | — |
| η | 10 | 5 | 100 | 100 |
| σ | 39 | 39.2 | 42 | 42 |
| s | — | 10 | 50 | 50 |
| q | 1 | 4 | 20 | 20 |

EXAMPLE 6

A coater of the type shown in FIG. 1 was provided with curtain holders of the type shown in FIG. 5 and used for three-layer coating. The curtain height h was 45 mm and the speed of travel v of the web 200 m/minute. A PE-coated paper 230 μm thick was coated. The curtain holders were arranged at an angle α of −2.5° to the vertical.

| | Curtain holders | Curtain | | |
|---|---|---|---|---|
| | | Layer 1 water and thickener | Layer 2 polyacryl-amide | Layer 3 polyacryl-amide |
| CM | — | | | |
| AL | water + thickener, dye and wetting agent | — | — | — |
| η | 10 | 5 | 60 | 60 |
| σ | 39 | 39.2 | 47.8 | 47.8 |
| s | — | 10 | 50 | 50 |
| q | 1 | 2 | 10 | 10 |

EXAMPLE 7

A coater of the type shown in FIG. 1 was provided with curtain holders of the type shown in FIG. 5 and used for three-layer coating. The curtain height h was 45 mm and the speed of travel v of the web 180 m/minute. A PE-coated paper 230 μm thick was coated. The curtain holders were arranged at an angle α of −2.5° to the vertical. The coating width amounted to 13.9 cm.

| | Curtain holders | Curtain | | |
|---|---|---|---|---|
| | | Layer 1 aqueous gelatin | Layer 2 aqueous gelatin | Layer 3 aqueous gelatin |
| CM | — | | | |
| AL | water + dye, thickener and wetting agent | — | — | — |
| η | 10 | 4 | 100 | 100 |
| σ | 38 | 28.5 | 29.4 | 29.4 |
| s | — | 10 | 50 | 50 |

-continued

| | Curtain holders | Curtain | | |
|---|---|---|---|---|
| | | Layer 1 aqueous gelatin | Layer 2 aqueous gelatin | Layer 3 aqueous gelatin |
| CM | — | | | |
| AL | water + dye, thickener and wetting agent | — | — | — |
| q | 0.5 | 1.8 | 9 | 9 |

Due to the shortage of auxiliary liquid in the curtain holders, the edges of the curtain were unstable and tore. Although it was possible to stabilize the curtain by increasing the rate of delivery of the auxiliary liquid from q=0.5 l/m minute to 1.66 l/m minute, this overdosage of auxiliary liquid made the peripheral bead too wide and thick.

EXAMPLE 8

A coater of the type shown in FIG. 1 was provided with curtain holders of the type shown in FIG. 5 and used for five-layer coating. The curtain height h was 45 mm and the rate of travel v of the web 270 m/minute. A PE-coated paper 230 μm thick was coated. The curtain holders were arranged at an angle α of −2.5° to the vertical. The coating width amounted to 13.9 cm.

| | Curtain holders | Curtain | | | | |
|---|---|---|---|---|---|---|
| | | Layer 1 photo-emul-sion | Layer 2 aqueous gelatin solution | Layer 3 photo-emul-sion | Layer 4 aqueous gelatin solution | Layer 5 photo-emul-sion |
| CM | — | | | | | |
| AL | water + dye, thickener and wetting agent | — | — | — | — | — |
| η | 10 | 21.6 | 85 | 78 | 65.2 | 23.5 |
| σ | 38 | 35.1 | 34.1 | 36.5 | 31.8 | 26.1 |
| s | — | 40 | 14 | 20 | 20 | 16 |
| q | 1.6 | 10.8 | 3.78 | 5.4 | 5.4 | 4.32 |

In this five-layer photographic emulsion coating process, the quantity of auxiliary liquid introduced into the curtain holder was increased to 1.6 l/m minute. The stability of the curtain was very good with a thin peripheral bead.

Coating quality was good and the width of the layers applied to the web corresponded exactly to the width of the layers dropping down from the coating edge.

EXAMPLE 9

The procedure was in Example 8, except that no auxiliary liquid was delivered to the holders (q=0). No curtain could be formed because the curtain could not be held by the curtain holders.

1. A process for stabilizing free-falling liquid curtains which comprise one or more layers, in the curtain coating of webs of objects advancing continuously past a coating station, characterized in that the free-falling curtain formed at the coating edge of a coater is laterally guided by the use of curtain holders from which an additional liquid issues towards and combines with the curtain, triangular stabilizing liquid bridges between the curtain and the curtain holders being formed from the coating edge to the point at which the curtain impinges on the layer support.

2. A process as claimed in claim 1, characterized in that the quantity of liquid introduced into the curtain holders for laterally guiding the curtain is gauged in such a way that the liquid bridges begin directly at the coating edge and become triangularly wider in the direction of fall of the curtain, enabling the free-falling curtain to undergo a stabilizing contraction.

3. A process as claimed in claim 1, characterized in that low viscosity liquids having viscosities of from 1 mPas to 20 mPas and preferably from 1 mPas to 10 mPas, are used for forming the liquid bridges between the curtain and the lateral curtain holders.

4. A process as claimed in claim 1, characterized in that the width of the curtain and the quantity of liquid issuing from the curtain holders are gauged in such a way that the layer support is coated with coating liquid right up to its edges and in such a way that the liquid issuing laterally from the curtain holders takes over the wetting of the edges of the layer support and, unless the liquid impinges on the web, it is collected and re-used.

5. A process as claimed in claim 1, characterized in that the width of the curtain and the quantity of liquid issuing from the curtain holders are gauged in such a way that the layer support is coated up to its edge with coating liquid and the liquid issuing laterally from the curtain holders and a small proportion of the coating liquid do not impinge on the layer support and are collected.

6. A process as claimed in claim 1, characterized in that the exact position and shape of the edges of the coating material on the layer support are determined by the angle $\alpha$ of the curtain holders to the vertical and by the quantity and type of auxiliary liquid.

7. A curtain coater incorporating a stabilizing system for the free-falling curtain for the single-layer or multiple layer coating of webs or objects advancing continuously past a coating station, characterized in that inwardly hollow curtain holders are arranged on both sides between the coating edge of the coater and the web for laterally guiding the curtain which are provided with a separate liquid supply and over the entire height with a distributing passage and a dispenser for dispensing the auxiliary liquid towards the curtain for the purpose of forming liquid bridges between the curtain and the curtain holders.

8. A curtain coater as claimed in claim 7, characterized in that the curtain holders are hollow bodies closed on top and underneath which are connected to a liquid supply system of which the interior acts a distributing passage for the auxiliary liquid and in that the tubular hollow bodies are provided with a slot as dispenser for the auxiliary liquid for forming the liquid bridges towards the curtain.

9. A curtain coater as claimed in claim 7, characterized in that the curtain holders are tubular hollow bodies closed on top and underneath which are of a porous, liquid permeable material, which are provided with a liquid supply system and which are covered over their entire surface with a layer of liquid for forming the liquid bridges.

10. A curtain coater as claimed in claim 7, characterized in that the curtain holders are hollow bodies closed on top and underneath having a liquid supply stream and, towards the curtain, a dispensing slot which is lined with a porous liquid-permeable material.

11. A curtain coater as claimed in claim 7, characterized in that the curtain holders are arranged closely adjacent the coating edge of the coater so that the liquid bridges begin directly at the coating edge and in that the curtain holders are arranged to pivot towards the curtain through an angle $+\alpha$ and away from the curtain through an angle $-\alpha$ in the plane of the vertically free-falling liquid curtain, the angle being variable from $-10°$ to $+10°$ and preferably from $-5°$ to $0°$.

12. A curtain coater as claimed in claim 7, characterized in that, for selecting the width "b" of the liquid bridges at the point where the curtain impinges on the layer support, the quantity of liquid introduced into the curtain holders is adjustable so that, depending on the quantity of liquid introduced, relatively small or relatively large triangular liquid bridges are formed on both sides of the curtain so that the position of the peripheral bead of the coating and the coating width are adjustable.

* * * * *